US005865486A

United States Patent [19]

Bussani

[11] Patent Number: 5,865,486

[45] Date of Patent: Feb. 2, 1999

[54] DOG FECES REMOVAL IMPLEMENT

[76] Inventor: Eliezer Bussani, 7, Haligboa St., Holon, Israel

[21] Appl. No.: 21,548

[22] Filed: Feb. 10, 1998

[51] Int. Cl.[6] ..... A01K 29/00; A47L 13/52

[52] U.S. Cl. ..... 294/1.3; 294/55; 15/257.1

[58] Field of Search ..... 294/1.1, 1.3, 55; 15/257.1, 104.8; 229/117.12, 122; 206/223

[56] References Cited

U.S. PATENT DOCUMENTS

| | | | |
|---|---|---|---|
| 4,186,955 | 2/1980 | Campbell | 294/1 R |
| 4,251,097 | 2/1981 | Whitten | 294/1 B |
| 4,272,116 | 6/1981 | Tufte, Jr. | 294/1.3 |
| 4,909,553 | 3/1990 | Hantover | 294/1 B |
| 5,039,148 | 8/1991 | Brautovich | 294/1.3 |
| 5,186,384 | 2/1993 | Nelson | 294/1.3 |

FOREIGN PATENT DOCUMENTS

| | | | |
|---|---|---|---|
| 2695147 | 3/1994 | France | 294/1.3 |
| 3542-098 | 6/1987 | Germany | 294/1.3 |
| 8500814 | 10/1986 | Netherlands | 294/1.3 |
| 665-861 | 6/1988 | Switzerland | 294/1.3 |
| 2249470 | 5/1992 | United Kingdom | 294/1.3 |
| 2258136 | 2/1993 | United Kingdom | 294/1.3 |

*Primary Examiner*—Dean Kramer
*Attorney, Agent, or Firm*—Robert W. J. Usher

[57] ABSTRACT

Precursors of a scoop and paddle are constituted by different, manually separable, portions of a single blank, defined by a line of weakness. The paddle precursor is at a rear central location of the blank, spaced apart from side edges of the blank so that a forward portion of the remainder forms a scoop receptacle precursor and side edge portions form precursors of scoop handles. Rearwardly convergent fold lines are provided in the forward portion so that, after the paddle is separated, opposite sides of the forward portion can be folded up to erect the scoop receptacle with a pair of handles extending rearwardly therefrom with raised adjacent ends for ease of grasping by a hand spaced safely away from the scoop receptacle eliminating risk of contact with feces or adjacent ground surfaces.

1 Claim, 1 Drawing Sheet

FIG. 1
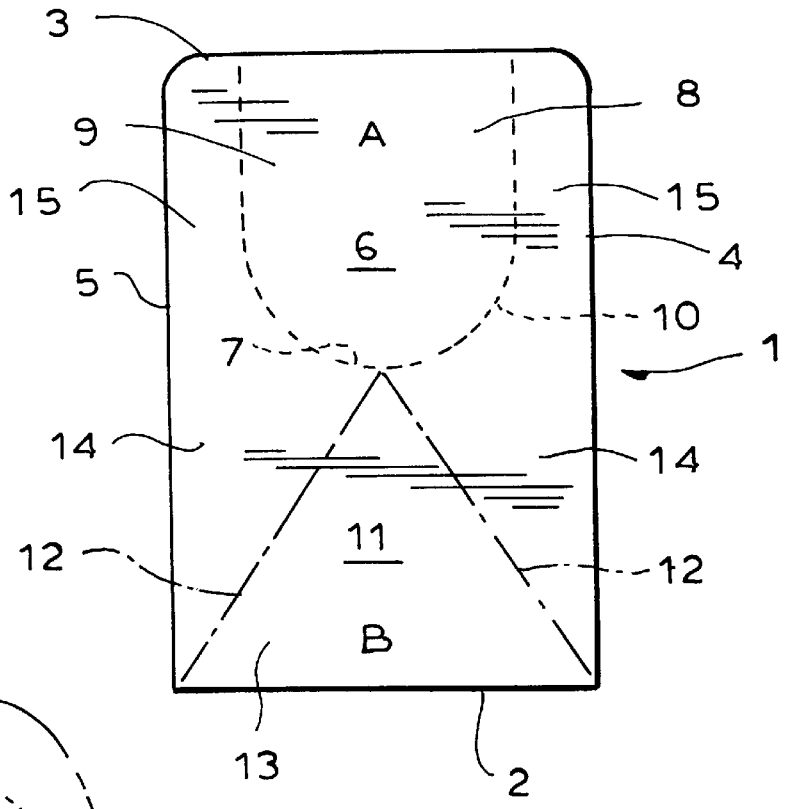
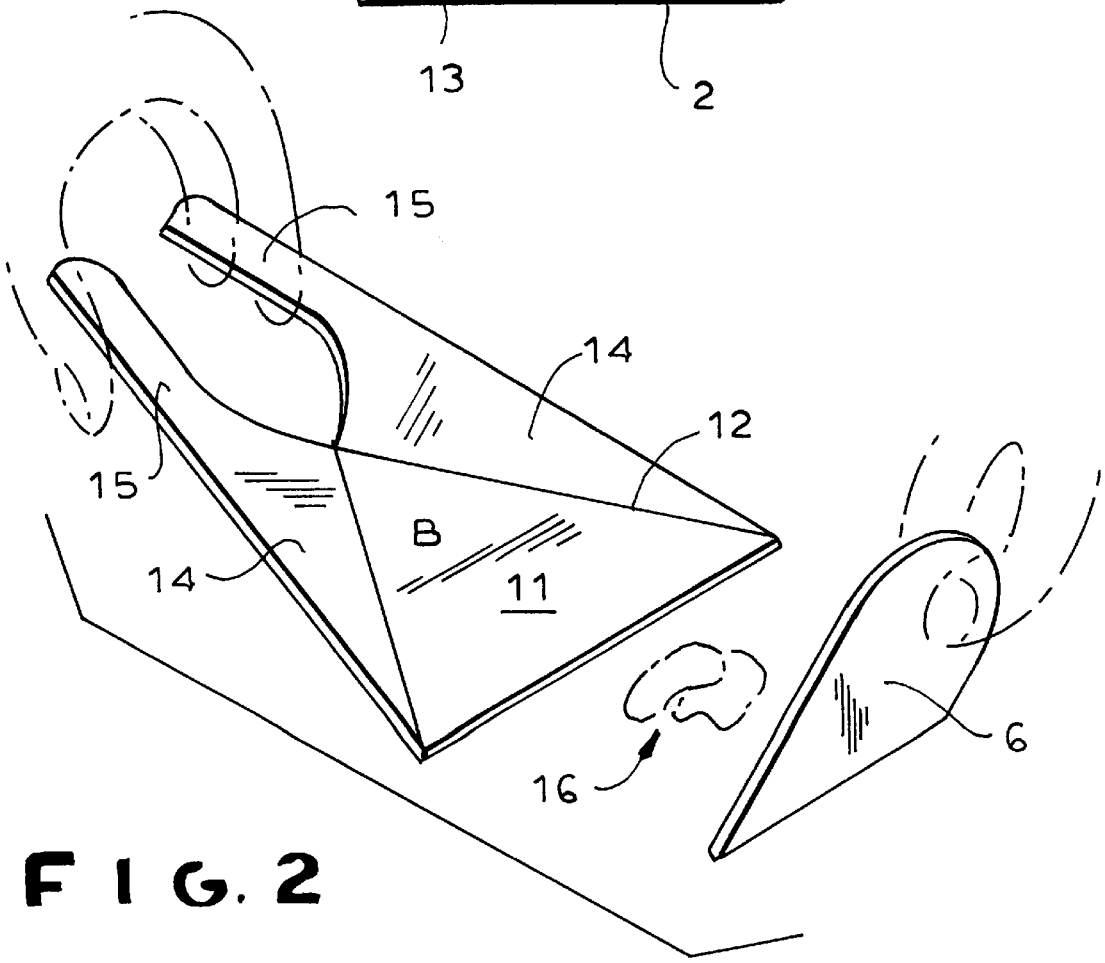
FIG. 2

DOG FECES REMOVAL IMPLEMENT

FIELD OF THE INVENTION

The invention relates to a disposable dog feces removal implement.

BACKGROUND OF THE INVENTION

The legal requirement for a person walking a dog to remove dog feces deposited on city streets has been established for many years and there have been numerous prior attempts to provide suitable implements.

Early proposals involving mechanical contrivances often with linked moving parts, requiring cleaning after use have been largely superseded by numerous attempts to provide simpler, less expensive and cumbersome, disposable implements which can be more readily carried by the dog owner and permit feces removal in a sanitary manner and with minimal embarrassment. However, such prior attempts are not considered to be wholly satisfactory successful.

For example, although U.S. Pat. No. 4,186,955 issued to Campbell in 1980 teaches a scoop and paddle formed from a single cardboard blank, the numerous folding steps would increase costs and require, for convenience, that the implement be carried in folded form, the several layers increasing thickness, reducing pocketability. The user also grasps the inside of a rear wall of the scoop increasing risk of inadvertent contact with the feces during use.

Whilst, U.S. Pat. No. 4,251,097 issued to Whitten in 1981 also teaches a scoop formed from a blank, in addition to several folding steps, erection requires flap portions to be threaded into interlocking relation with a common slot which requires some manual dexterity and can be inconveniently time consuming on the street.

U.S. Pat. No. 5,039,148 issued to Brautovich in 1991 teaches a scoop which can be carried in folded flat condition of less than one-eighth thickness. However, a complex, multipart construction is taught requiring assembly of several different materials and therefore relatively expensive to manufacture.

Although U.S. Pat. No. 4,909,553 issued to Hantover in 1990, discloses formation of two (identical) scoop/paddle structures from a single cardboard blank, the patent also teaches that the implement be carried in folded condition about a bag with the plural layers increasing bulk and reducing pockectablity, while to scavenge feces, the user grasps the inner surface of a bottom wall which also increases risk of inadvertent contact with the feces.

In particular, none of the above implements provide handles extending clear of a receptacle portion of the scoop to enable the user to effectively manipulate the implement or scoop while maintaining his hand safely remote from risk of contact and contamination by the feces.

SUMMARY OF THE INVENTION

It is an object of the invention to provide a disposable dog feces removal implement of the scoop and paddle type, which is of very low cost, convenient for the user to carry in a pocket, easy for the user to erect in the street when required and reliable, easy and hygienic in use.

It is a further object of the invention to form such implement as a unitary blank suitable for insertion as a flier in a magazine or newspaper and for use as an advertising display or, possibly, given away with dog supplies.

According to the invention, precursors of the scoop and paddle are constituted by manually separable, portions of a single blank, defined by a line of weakness or tear line with the paddle precursor at a rear central location of the blank, spaced apart from side edges of the blank so that a forward portion of the remainder forms a precursor of a scoop receptacle and side edge portions on opposite sides of the paddle precursor form precursors of scoop handles. Rearwardly extending fold lines are provided in the forward portion so that, after the paddle is separated, opposite sides of the forward portion can be folded up to erect the scoop receptacle with a pair of handles extending rearwardly clear of the receptacle portion distancing a user's hand from the scoop receptacle thereby avoiding risk of contamination by dog feces.

Preferably, the fold lines converge rearwardly so that the folding step raises the rear ends of the handles towards each other into adjacent relation for ease of grasping and above the level of the receptacle assuring that the user's hand is spaced further way from the bottom of the scoop receptacle eliminating risk of contact with feces or adjacent ground surfaces.

The manual grasping force uging the handles together also maintains the scoop in erect condition for effectively scavenging feces from the sidewalk.

BRIEF DESCRIPTION OF THE DRAWINGS

A specific embodiment of a disposable dog feces removal implement kit according to the invention will now be described by way of example only with reference to the accompanying drawings in which:

FIG. 1 is a plan view of a blank, a precursor of the scoop and paddle implement, and FIG. 2 is a perspective view of the scoop and paddle erected from the blank shown in FIG. 1.

DESCRIPTION OF PARTICULAR EMBODIMENT

As shown in FIG. 1, the implement comprises a rectangular cardboard blank 1 having minor front and rear edge portions 2 and 3, respectively, joined by transverse major longitudinally extending side edges portions 4 and 5, respectively. A paddle precursor 6 comprising a removable elongate panel having a circular forward edge 7 and parallel side edge portions 8 and 9 which extend rearwardly therefrom equispaced from the side edge portions 4 and 5, is defined at a central rear location of the blank by a line of weakness 10 in which the blank material is severed through except for three, equi-spaced, residual web portions. The remainder of the blank forms a scoop precursor 11 in which two fold lines 12 converge rearwardly from front corners of the blank to the center of the forward edge 7 defining panel- form precursors of a triangular, flat receptacle bottom wall 13 and side walls or flanges 14 upstanding from respective opposite sides of the bottom wall with rearward handles 15 defined by residual blank material between the line of weakness and the adjacent portions of side edges 4 and 5.

This construction enables the user to carry one or more blanks 1 conveniently in his pocket and, when required for use, simply to break away the panel 6 along the line of weakness to form the paddle and then turn up the panels 14 about the fold lines 12 to form a scoop receptacle 13 with the two handles 15 extending rearwardly from respective side walls 14 raised clear of the bottom wall 13.

Feces 16 can then be scooped up with the aid of the paddle as shown in FIG. 2 with the user gripping the handles in one hand without risk of contact with the feces or the ground.

The handle gripping action assists and urges the free rear ends of the handles toward each other maintaining the side walls upstanding from the bottom wall to ensure that the trough-like receptacle shape of the scoop is maintained throughout even vigorous use.

Although the rear ends of the handles are shown to be spaced apart in FIG. 2 when grasped, it will be appreciated that during vigorous scavenging, tightening the grip will force the handles closer together and eventually into abutment, increasing the height of the handles and side walls above the bottom wall and providing a strong scraping structure.

Appropriate advertising logos/slogans A and B may be marked on faces of the paddle and scoop as indicated.

What we claim is:

1. A disposable dog feces removal implement kit of a scoop and paddle type constituted by a unitary cardboard blank of single thickness stock, the blank being rectangular having front and rear edge portions joined perpendicularly by opposite side edge portions, a removable, elongate paddle precursor panel with parallel sides and a tapering forward end extending forwardly from the rear edge at a rear central location which is spaced from the opposite side edges, being defined by a frangible line of weakness which intersects the rear edge portion so that a remainder of the blank constitutes a scoop precursor, fold lines extending rearwardly, in convergent relation, from opposite front corners to a central location of the forward end to the line of weakness, whereby the paddle can be manually separated at the line of weakness and the scoop formed from the remainder by manually folding up the opposite side edge portions about respective fold lines to provide a forward dog feces receptacle portion with a bottom wall and opposite, upstanding side walls increasing in height as they extend rearwardly and a pair of handles extending rearwardly from the side walls away from the receptacle portion with rear ends of the handles being together in adjacent, relation, raised above the bottom wall.

* * * * *